United States Patent [19]

Katz et al.

[11] 4,184,724

[45] Jan. 22, 1980

[54] HOSPITAL FURNITURE

[75] Inventors: Hugh S. Katz, St. Louis; Anthony N. Garrett, Clayton, both of Mo.

[73] Assignee: LVK Associates, Inc., St. Louis, Mo.

[21] Appl. No.: 880,460

[22] Filed: Feb. 23, 1978

[51] Int. Cl.[2] ..... A47B 95/02

[52] U.S. Cl. ..... 312/209; D6/192; 49/460; 220/94 R; 248/345.1; 312/320

[58] Field of Search ..... 312/320, 293, 209, 138 R, 312/245, 244, 296; 49/460; 248/345.1; D6/191, 192; 220/85 K, 94 R, 94 A, 73, 74

[56] References Cited

U.S. PATENT DOCUMENTS

| | | | |
|---|---|---|---|
| 495,162 | 4/1893 | Palm | 312/296 |
| 2,243,841 | 6/1941 | DiBella | 248/345.1 |
| 2,653,851 | 9/1953 | Davidson | 312/320 |
| 2,948,576 | 8/1960 | Ball | 312/296 |
| 3,009,214 | 11/1961 | Thompson | 49/460 |

*Primary Examiner*—Robert L. Wolfe
*Assistant Examiner*—Alex Grosz
*Attorney, Agent, or Firm*—Koenig, Senniger, Powers and Leavitt

[57] ABSTRACT

An article of hospital furniture having bottom, top and side walls and a closure for closing an opening at the front of the article, the closure being adapted to be pulled open from a closed position. The closure comprises a front panel and an elongate flexible gripping member secured to the periphery of the panel. This member extends along edges of the panel and around corners of the panel and is of frictional material to facilitate pulling the closure open by exerting pressure on the member and pulling it forwardly.

16 Claims, 5 Drawing Figures

HOSPITAL FURNITURE

BACKGROUND OF THE INVENTION

This invention relates to hospital furniture and more particularly to improved means for opening a door or drawer of an article of hospital furniture. Weakened or disabled patients may experience difficulty in opening the doors or drawers of furniture having conventional handles or latches. The furniture of this invention features means particularly suited for use by persons having limited strenth, motor skill or dexterity, such as hospital patients.

SUMMARY OF THE INVENTION

Among the several objects of this invention may be noted the provision of an improved article of hospital furniture having a door or drawer which readily can be opened by weak or handicapped persons, such as hospital patients; the provision of such an article of furniture wherein the means for opening the door or drawer is easy to use and which reduces the possibility of injury due to striking the door or drawer; and the provision of such means which lends a pleasing appearance to the furniture and which is simple in design for easy maintenance.

Briefly, an improved article of hospital furniture of this invention has bottom, top, and side walls and a closure for closing an opening at the front of the article, the closure being adapted to be pulled forwardly from a closed position in which it closes the opening to an open position. This closure comprises a front panel and an elongate flexible gripping member secured to the periphery of the panel. The member extends along edges of the panel and around corners of the panel and is of frictional material to facilitate pulling the closure open by exerting pressure on the member and pulling it forwardly.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
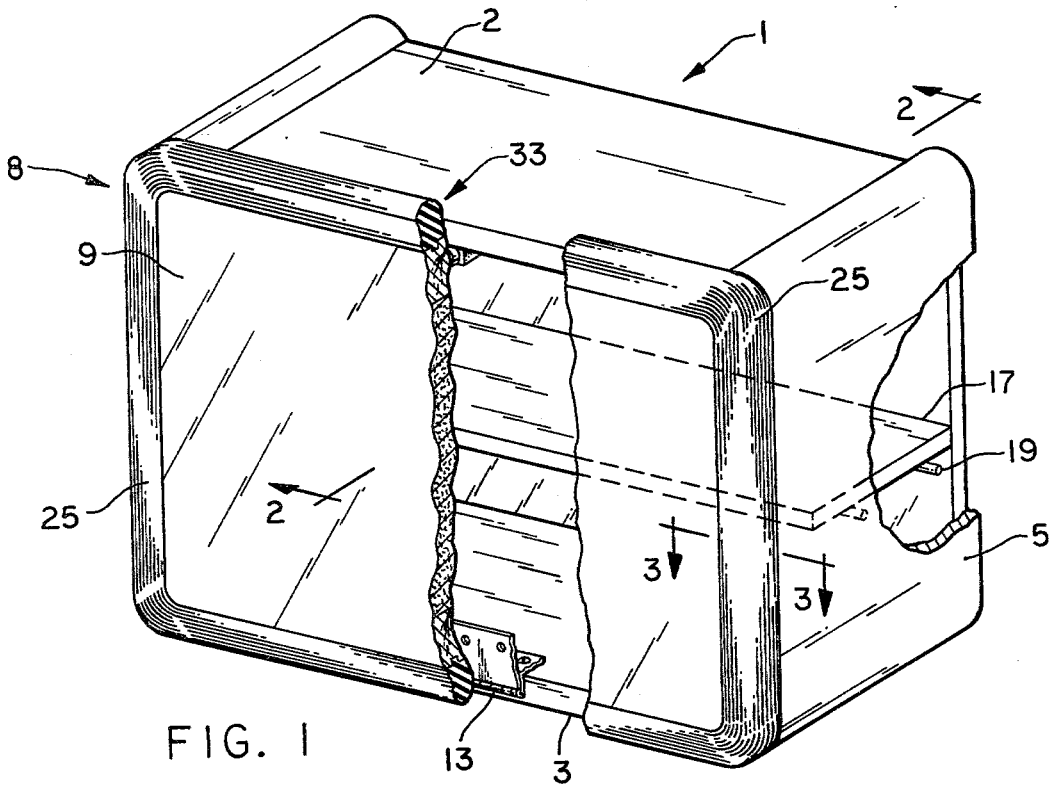
FIG. 1 is a perspective of an improved article of hospital furniture of this invention.
Figure 2:
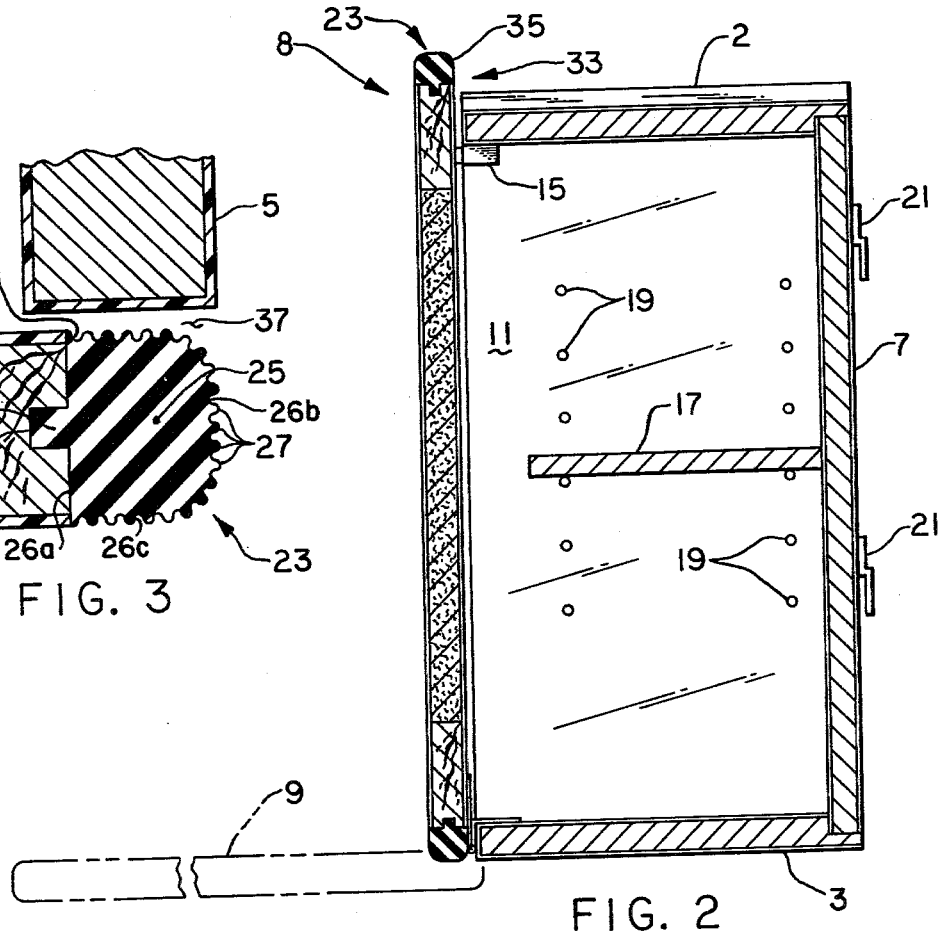
FIG. 2 is a vertical section on line 2—2 of FIG. 1.

Referring now to FIGS. 1 and 2 of the drawings, an article of hospital furniture of this invention is shown to comprise a cabinet, designated in its entirety by the reference numeral 1, having a top wall 2, a bottom wall 3, side walls 5 and a back wall 7, all of suitable construction, such as glued and nailed particle board substratum having high-pressure plastic laminate on opposite faces thereof. To reduce the possibility of injury to users such as hospital personnel and patients, the outer surface of the cabinet 1 is rounded or curved where the cabinet bottom wall 3 joins the cabinet side walls 5 and where the side walls meet the top wall.

A closure, generally designated 8, closes an opening 11 at the front of the cabinet and comprises a front closure panel or door 9. This door 9, which is preferably constructed of a wood-framed, foam-base material having high-pressure plastic laminate on opposite faces thereof, is generally rectangular in shape and hinged at 13 at the bottom of the cabinet. A magnetic latch 15 constitutes means for magnetically holding the door 9 in a closed position (shown in solid lines in FIG. 2) in which the upper margin of the door extends up above the top wall 2 of the cabient. The door 9 is adapted to be swung from a closed position to an open position (shown in phantom in FIG. 2) by pulling the door forwardly and then downwardly as it swings along its arcuate path. Within the cabinet there is a shelf 17 for receiving medicinal supplies or the like, the shelf being adjustable heightwise of the cabinet via a series of shelf pins 19. Indicated at 21 is a pair of mounting clips secured to the back wall 7 of the cabinet for hanging the cabinet if so desired.

Figure 3:
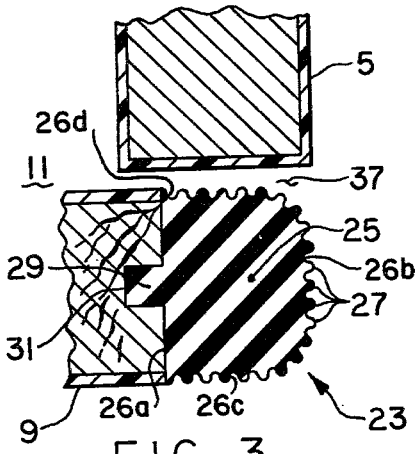
FIG. 3 is an enlarged horizontal section taken on line 3—3 of FIG. 1.

In accordance with this invention, the closure 8 further comprises improved means generally indicated at 23 on the cabinet door 9 for opening the latter, this means being particularly suited for use by persons having limited motor skills or dexterity, such as hospital patients. Means 23 comprises an elongate flexible gripping member 25 which extends along the top, bottom and side edges of the door 9 and around the corners of the door, with the radius of curvature of the member at the corners being preferably 2". This member 25 is a solid bar member, generally rectangular in cross-section, and has a first side **26*a* engageable with the periphery of door 9, a second second side 26*b* opposite the first face, and forward and rearward sides indicated at 26*c* and 26*d*, respectively, extending between the first and second faces 26*a*, 26*b*. As shown, the member, which is of frictional material, preferably a relatively soft elastomer such as neoprene, is rounded at the intersection of the first side 26*a* and rearward face 26*d* and also at the intersection of the first side and the forward face 26*c*. A plurality of closely spaced ribs, each designated 27 and preferably of the same material as member 25 (e.g., neoprene), extend lengthwise of the member (see FIGS. 1 and 3). Indicated at 29 is a tongue which is formed integrally with the gripping member and which projects down from side 26*a* along the entire length of the member. This tongue is received in a groove 31 in the periphery of the door and held therein for securing the member 25 to the door 9**.

The cabinet door 9 may easily be opened by simply exerting pressure anywhere along the gripping member 25 at the top or sides of the door 9 and pulling forwardly. The fact that the member is ribbed and of frictional material facilitates pulling the door open via the member.

As best shown in FIG. 2, when the door 9 is closed, the gripping member 25 on the upper edge of the door panel (comprising the upper margin of the door) projects above the top wall 2 of the cabient, the rearward side **26*d* of the gripping member (as well as the upper portion of the door) thus providing a pulling surface for more readily opening the door at the top of the cabinet. And inasmuch as the sides 5** of the cabinet also extend up above the cabinet top, the latter is enclosed for decreasing the likelihood of items falling off the cabinet top to the floor.

When the door 9 is closed, the portion of the rearward side 26*d* adjacent the first side 26*a* of the gripping member 25 substantially abuts the front edges of the cabinet side walls 5 (see FIG. 3, while) the portion of the rearward side 26*d* adjacent the second side 26*b* is rounded to provide a recess 37 between the gripping member and the cabinet. This affords a finger grip to assist in pulling the door open (see FIG. 3) at the sides of the cabinet. As shown, the outer surface of the gripping member along the side edges of the door is generally flush with the outside surface of the cabinet side walls for enhancing the attractiveness of the cabinet.

As illustrated, the gripping member 25, which is preferably of one-piece construction (although not necessarily so), extends around the entire periphery of the front door 9, thus providing both a pleasing appearance and a maximum amount of gripping surface for pulling the door open. In this latter regard, however, it should be understood that while the gripping member should be on at least a substantial part of the door periphery, it need not extend completely around the door. The relatively smooth and soft gripping member 25 is further advantageous inasmuch as it covers the sharp edges and corners of the door 9 thereby to reduce the possibility of injuries.

Figure 4:
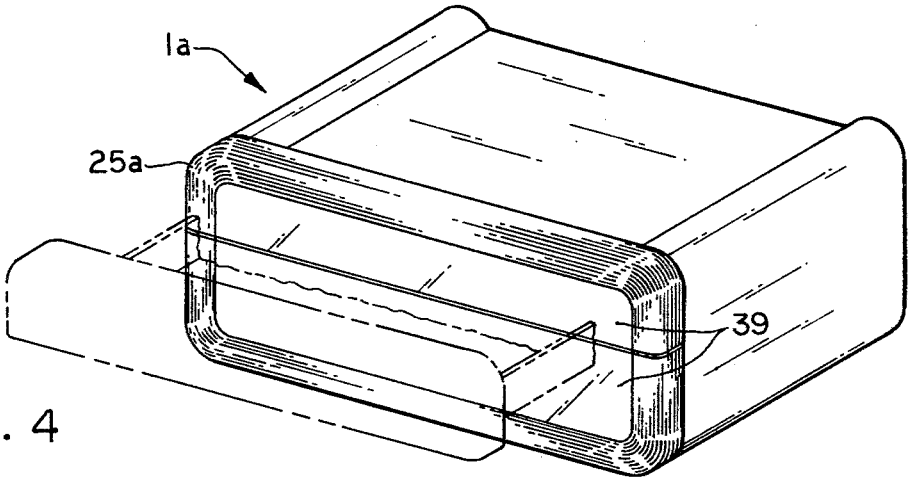
FIG. 4 is a perspective of an alternative article of hospital furniture.
Figure 5:
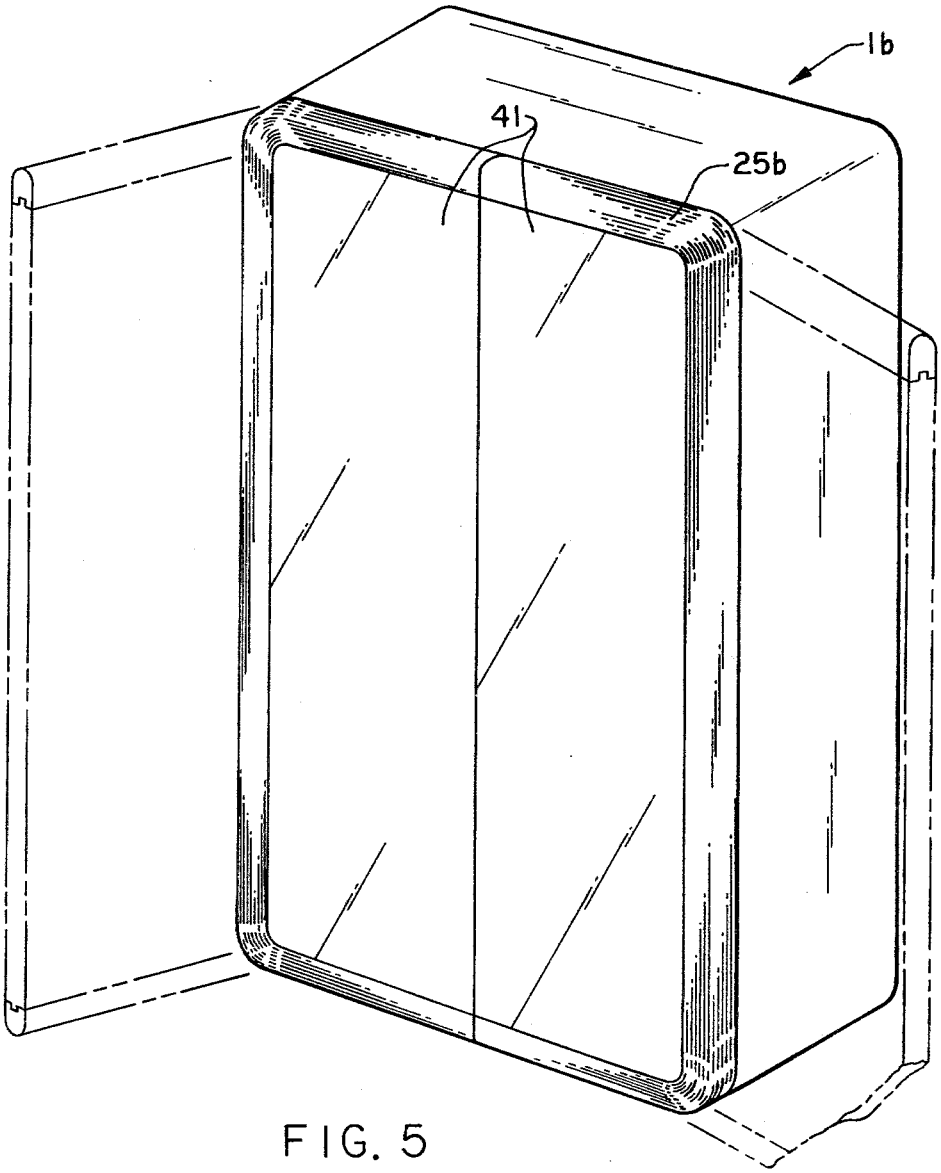
FIG. 5 is a perspective of another alternative article of hospital furniture.

FIGS. 4 and 5 show two different articles of hospital furniture having thereon gripping members identical in structure and function to the gripping member 25 discussed above. More specifically, FIG. 4 shows a cabinet 1*a* having a pair of drawers 39 slidable therein (the top drawer being shown open in phantom). A gripping member 25*a* is secured to the periphery of each drawer for pulling it open. FIG. 5 shows a wardrobe 1*b* having double doors 41 hinged at opposite sides of the wardrobe for swinging between open (shown in phantom) and closed (shown in solid lines) positions. The doors 41 are swung open by pulling on gripping members 25*b* secured to the edges of the doors. The gripping member 25 of this invention may, of course, be used in conjunction with other types of furniture having closures adapted to be pulled open. And it may also have other suitable functions outside the furniture art.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An article of hospital furniture having bottom, top and side walls, a closure for closing an opening at the front of the article, said closure being adapted to be pulled forwardly from a closed position in which it closes the opening to an open position, and closure comprising a front panel having secured to its periphery an elongate flexible gripping member which extends along edges of the panel and around corners of the panel and is of frictional material to facilitate pulling the closure open by exerting pressure on the member and pulling forwardly, said member being a solid bar member having a first side engageable with the periphery of the panel a second side opposite the firstside, and forward and rearward sides extending between the first and second sides and means for magnetically holding the panel in its closed position.

2. An article of hospital furniture as set forth in claim 1 wherein the gripping member is of one-piece construction and extends substantially around the entire periphery of the panel.

3. An article of hospital furniture as set forth in claim 1 wherein the gripping member has raised portions thereon further to facilitate pulling said closure open by exerting pressure on the member and pulling forwardly.

4. An article of hospital furniture as set forth in claim 3 wherein said raised portions comprise a plurality of ribs extending lengthwise of the member.

5. An article of hospital furniture as set forth in claim 1 wherein said material comprises an elastomer.

6. An article of hospital furniture as set forth in claim 5 wherein the elastomer is neoprene.

7. An article of hospital furniture as set forth in claim 1 wherein a portion of said rearward side of the gripping member adjacent said first side is adapted to substantially abut the article of furniture at its front when the closure is in its closed position and a portion of the rearward side adjacent said second side is formed to provide a recess between the member and the article of furniture at the front of the latter when the closure is closed, said recess providing a finger grip to assist in pulling the closure open.

8. An article of hospital furniture as set forth in claim 7 wherein said member is generally rectangular in cross section and rounded at the intersection of said second side and said rearward side to provide said recess.

9. An article of hospital furniture as set forth in claim 1 wherein a margin of said closure projects outwardly beyond at least one of said walls when said closure is closed, the rear of the closure providing a pulling surface for opening the latter.

10. An article of hospital furniture as set forth in claim 1 wherein there is a tongue-and-groove connection between the panel and the gripping member.

11. In an article of hospital furniture having bottom, top and side walls and a front closure panel for closing an opening at the front of the article, said panel being adapted to be pulled forwardly from a closed position in which it closes the opening to an open position, the improvement comprising a means for opening the panel comprising an elongate flexible gripping member secured to the periphery of the panel and extending along edges of the panel and around corners of the panel, said gripping member being of frictional material to facilitate pulling the panel open by exerting pressure on the member and pulling forwardly, and said member being a solid bar member having a first side engageable with the periphery of the panel, a second side opposite the first side, and forward and rearward sides extending between the first and second sides and means for magnetically holding the panel in its closed position.

12. An article of hospital furniture as set forth in claim 11 wherein the gripping member has raised portions thereon further to facilitate pulling said closure open by exerting pressure on the member and pulling forwardly.

13. An article of hospital furniture as set forth in claim 12 wherein said raised portions comprise a plurality of ribs extending lengthwise of the member.

14. An article of hospital furniture as set forth in claim 11 wherein said material is neoprene.

15. An article of hospital furniture as set forth in claim 11 wherein said member is generally rectangular in cross section and rounded at the intersection of said second side and said forward side and at the intersection of said second side and said rearward side.

16. For pulling open a closure panel or the like, an elongate flexible gripping member adapted to be secured along edges of the panel and to be pulled in a direction constituting the forward direction to open the closure panel, said member being a solid bar member of generally rectangular cross section having a first side engageable with the periphery of the panel, a second side opposite the first side, and forward and rearward sides extending between the first and second sides, said member being rounded at the intersection of said second side and said forward side and at the intersection of said second side and said rearward side, and the member having a plurality of ribs of frictional material extending lengthwise thereof to facilitate pulling the closure panel open by exerting pressure on the member and pulling forwardly, said member further having a tongue formed integrally therewith projecting from said first side along the entire length of the member for being received in a groove in said panel edges for securing the member to the panel.

* * * * *

UNITED STATES PATENT AND TRADEMARK OFFICE

CERTIFICATE OF CORRECTION

PATENT NO. : 4,184,724

DATED : January 22, 1980

INVENTOR(S) : Hugh S. Katz and Anthony N. Garrett

It is certified that error appears in the above-identified patent and that said Letters Patent are hereby corrected as shown below:

Column 2, line 35, "second second side" should read -- second side --. Column 3, line 57, "and closure" should read -- said closure --; Line 65, "panel a" should read -- panel, a --; Line 65, "firstside" should read -- first side --.

Signed and Sealed this

*Sixth* Day of *May 1980*

[SEAL]

*Attest:*

SIDNEY A. DIAMOND

*Attesting Officer*

*Commissioner of Patents and Trademarks*